US006374622B1

(12) United States Patent
Zhang et al.

(10) Patent No.: US 6,374,622 B1
(45) Date of Patent: Apr. 23, 2002

(54) ICE BANK CONTROL WITH VOLTAGE PROTECTION SENSING

(75) Inventors: Ming Zhang, Akron; Joseph W. Shannon, Kent, both of OH (US); Brian C. Jones, New Hartford, CT (US)

(73) Assignee: IMI Cornelius Inc., Anoka, MN (US)

( * ) Notice: Subject to any disclaimer, the term of this patent is extended or adjusted under 35 U.S.C. 154(b) by 0 days.

(21) Appl. No.: 09/762,880

(22) PCT Filed: Aug. 12, 1999

(86) PCT No.: PCT/US99/18366

§ 371 Date: Apr. 16, 2001

§ 102(e) Date: Apr. 16, 2001

(87) PCT Pub. No.: WO00/09960

PCT Pub. Date: Feb. 24, 2000

(51) Int. Cl.[7] ..... F25C 1/00
(52) U.S. Cl. ..... 62/139; 62/59
(58) Field of Search ..... 62/139, 59

(56) References Cited

U.S. PATENT DOCUMENTS 2,632,308 A * 3/1953 Engelhardt ..... 62/59
3,496,733 A * 2/1970 Parker et al. ..... 62/59
3,502,899 A * 3/1970 Jones ..... 62/59
4,011,733 A * 3/1977 Kuckens et al. ..... 62/59
4,497,179 A * 2/1985 Ivans ..... 62/59
4,703,770 A * 11/1987 Arzberger et al. ..... 137/88
4,754,609 A * 7/1988 Black ..... 62/59
4,843,830 A * 7/1989 Haul ..... 62/59
5,022,233 A * 6/1991 Kirschner et al. ..... 62/138
5,757,667 A * 5/1998 Shannon et al. ..... 364/510
5,839,291 A * 11/1998 Chang ..... 62/126
6,003,318 A * 12/1999 Busick et al. ..... 62/3.64
6,220,047 B1 * 4/2001 Vogel et al. ..... 62/342

* cited by examiner

*Primary Examiner*—William E. Tapolcai
(74) *Attorney, Agent, or Firm*—Sten Erik Hakanson

(57) ABSTRACT

The present invention is an apparatus and method that regulates the size of an ice bank (50) and that prevents short cycling of the compressor (30) therefor and operation thereof at undesired voltages. A microprocessor based control circuit (10) includes a circuit for sensing line voltage (14) combined with an ice bank sensing circuit (18, 20). The ice bank sensing circuit is of the conductivity sensing type wherein the electrical conductivity between two probes (P1, P2) is sensed. The microprocessor (16) continually monitors the probes (P1, P2) to determine if refrigeration is needed or not, and continually senses the line voltage to determine if that voltage is within the design limits of the refrigeration compressor (30). The voltage sensing circuit (14) can also sense if power has been interrupted where the voltage drops to zero.

2 Claims, 4 Drawing Sheets

ICE BANK CONTROL WITH VOLTAGE PROTECTION SENSING

FIELD OF THE INVENTION

The present invention relates generally to electronic ice bank controls and to voltage sensing controls.

BACKGROUND OF THE INVENTION

Ice banks that are formed on evaporators for providing a cooling reserve, as used in the beverage dispensing industry, are well known. The size of an ice bank is typically regulated by one or more sensors placed at critical positions around an outer perimeter thereof. Conductivity sensors are known and are used in this regard to determine the presence of ice or water by virtue of the conductivity between a pair of probes. Thus, if ice forms between the probes the sensed conductivity will be relatively low, and if water is present there between, the sensed conductivity will be much greater. Therefore, if ice is sensed, the ice bank is presumed to be of adequate size and the refrigeration compressor, that is used to cool the evaporator and form ice thereon, can be shut off. Conversely, if water is sensed, the compressor is turned on to build ice until ice is again sensed. Naturally, such controls have delay times programmed therein to prevent destructive short cycling of the compressor.

It is also well understood that it can be harmful to a compressor if it is made to run at a voltage that is outside, above or below, the voltage range for which it is designed. This situation is common for beverage dispensing equipment used in remote areas where line voltage can fluctuate dramatically. Buck/Boost systems, that attempt to lower or raise the voltage, respectively, have been attempted, but without great success do to the complexity and cost thereof. Adding a voltage sensing system that can turn the compressor off if its voltage design limits are exceeded, is also a possibility. However, the cost of an additional electronic control can be unacceptable. Especially where such an additional control would need to become a standard part of all such dispensers, many of which will experience no need therefor. It is also generally too expensive to provide such voltage sensing as a custom feature. Accordingly, it would be desirable to have a cost effective control for an ice bank that both regulates the size thereof, that protects the compressor against short cycling and from operating at voltages outside its design specification.

SUMMARY OF THE INVENTION

The present invention is an apparatus and method that regulates the size of an ice bank and that prevents short cycling of the compressor and operation thereof at undesired voltages. A microprocessor based control circuit includes a circuit for sensing line voltage combined with an ice bank sensing circuit. The ice bank sensing circuit is of the conductivity sensing type wherein the electrical conductivity between two probes is sensed. Thus, the microprocessor continually monitors the probes to determine if refrigeration is needed or not, and continually senses the line voltage to determine if the voltage is within the design limits of the refrigeration compressor. The voltage sensing circuit can also sense if power has been interrupted where the voltage drops to zero.

In operation, the present invention will turn on the compressor if the ice bank sensor indicates water is present between the probes, the voltage is within operating limits and if a predetermined time delay has elapsed since the last compressor shut down. The compressor is turned off if, during operation thereof, the ice bank is of sufficient size, the voltage goes outside of design limits or there is a power failure. It can be appreciated that the voltage sensing circuit can be comprised essentially of a relatively inexpensive voltage divider circuit of a dedicated transformer. Therefore, the present invention utilizes the inexpensive combination of such a voltage sensing circuitry with a conductivity/ice sensing circuit to provide for an ice bank control that is more protective of the compressor with respect to both short cycling and operating at voltages outside the manufacturer's recommended specifications, than is found in prior art ice bank sensing controls. Since the improved control of the present invention is relatively inexpensive, it can be used as a standard item rather than as a more costly custom or add on feature.

DESCRIPTION OF THE DRAWINGS

A further understanding of the structure, function, operation, and objects and advantages of the present invention can be had by referring to the following detailed description which refers to the following figures, wherein.

DETAILED DESCRIPTION OF THE PREFERRED EMBODIMENT

Figure 1:
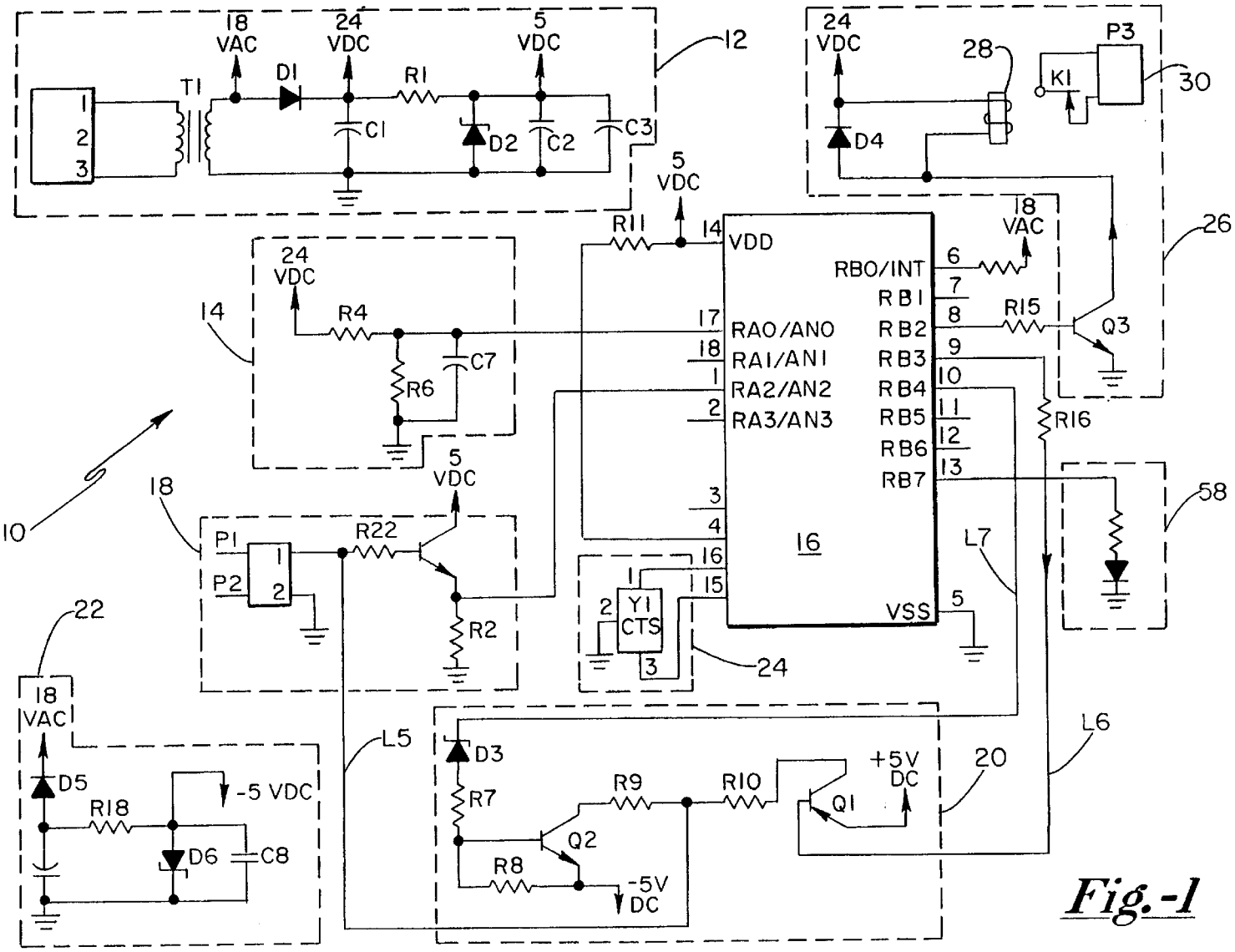
FIG. 1 shows an electrical schematic of the control of the present invention.

The control system of the present invention is seen in FIG. 1 and generally designated by the numeral 10. Control 10 includes a power supply circuit 12 including a transformer T1 connected to a power source, in this example, of 115VAC. Power supply 12 provides for outputs of 18VAC, 24VDC and 5VDC, where D1 provides for the rectification of the current from AC to DC. R4, R6 and C7 comprise a voltage detection circuit 14 wherein the voltage along the 24VDC line is sensed. Circuit 14 is connected to a microprocessor 16 by pin 17. Those of skill will understand that R4 and R6 function as a voltage divider circuit to bring the detected voltage changes within a range that is useful to microprocessor 16. Of course, microprocessor 16 also includes an analog to digital converter for converting the DC signal from circuit 14 to a usable digital form. In the present example, microprocessor 16 is a Microchip model PIC16C11.

Ice bank detection probes P1 and P2 form part of an ice probe circuit 18. R22, R2 and Q5 comprise a signal conditioning circuit with an input to pin 1 of microprocessor 16. This conditioning is needed as the probe input impedance is generally too high for microprocessor 16. Probe P1 is connected by line L5 to probe signal circuit 20, and output pins 9 and 10 are connected to circuit 20 by lines L6 and L7. Resistors R7, R8, R9 and R10 along with diode D3 and transistors Q1 and Q2 provide for a 5VDC signal and a −5VDC signal to L5. The −5VDC is provided by power supply circuit 22.

A clock circuit 24 is provided and connected to microprocessor 16 by input pins 15 and 16. A power relay switching circuit 26 includes a relay 28 for operating a switch K1. Switch K1 is connected to a compressor 30. Pin 8 of microprocessor 16 is connected to circuit 26 for controlling the operation of relay 28. Pin 6 can be used to detect the line power interruptions.

Figure 2:
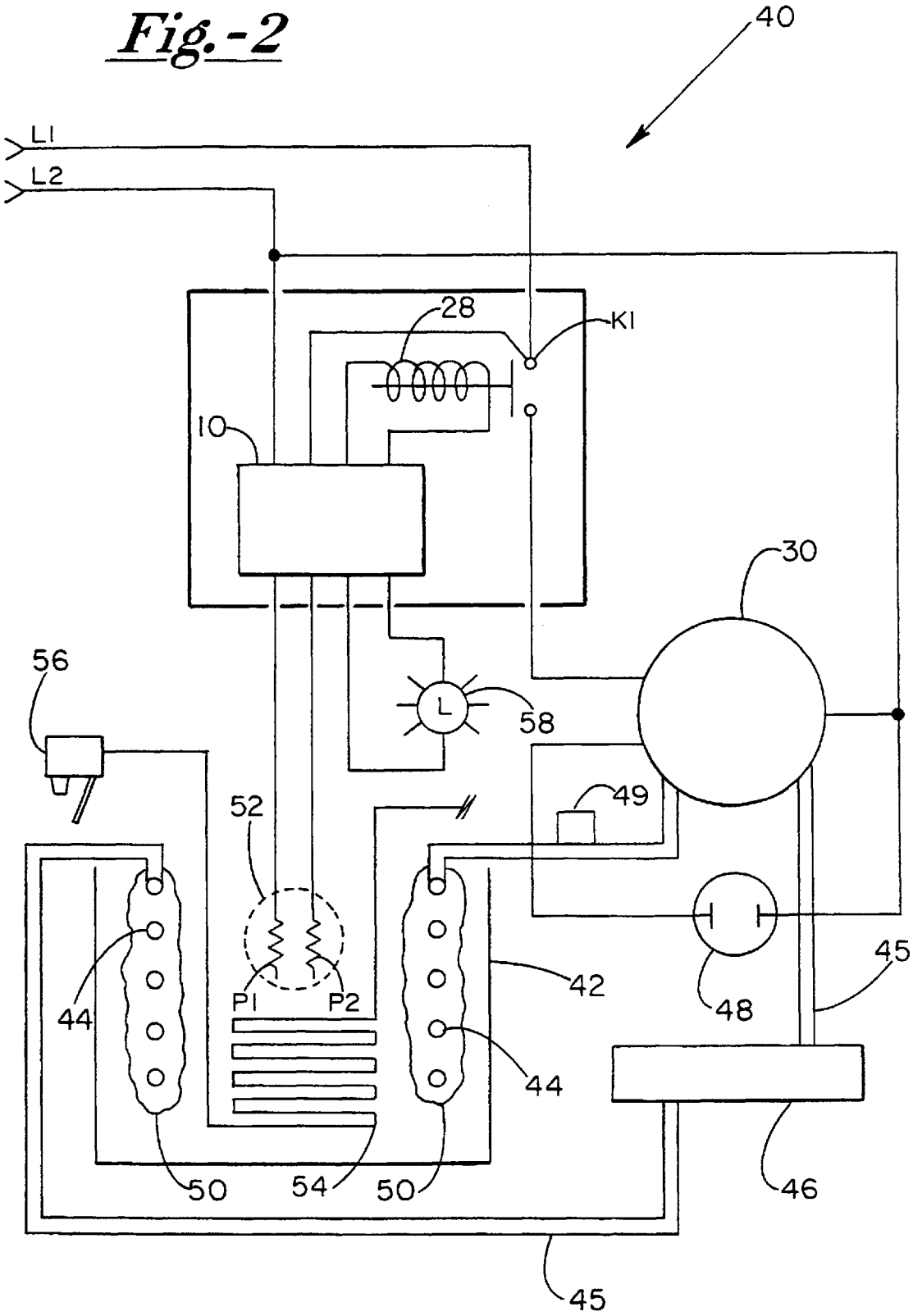
FIG. 2 shows a schematic diagram of the present invention.
Figure 3A:
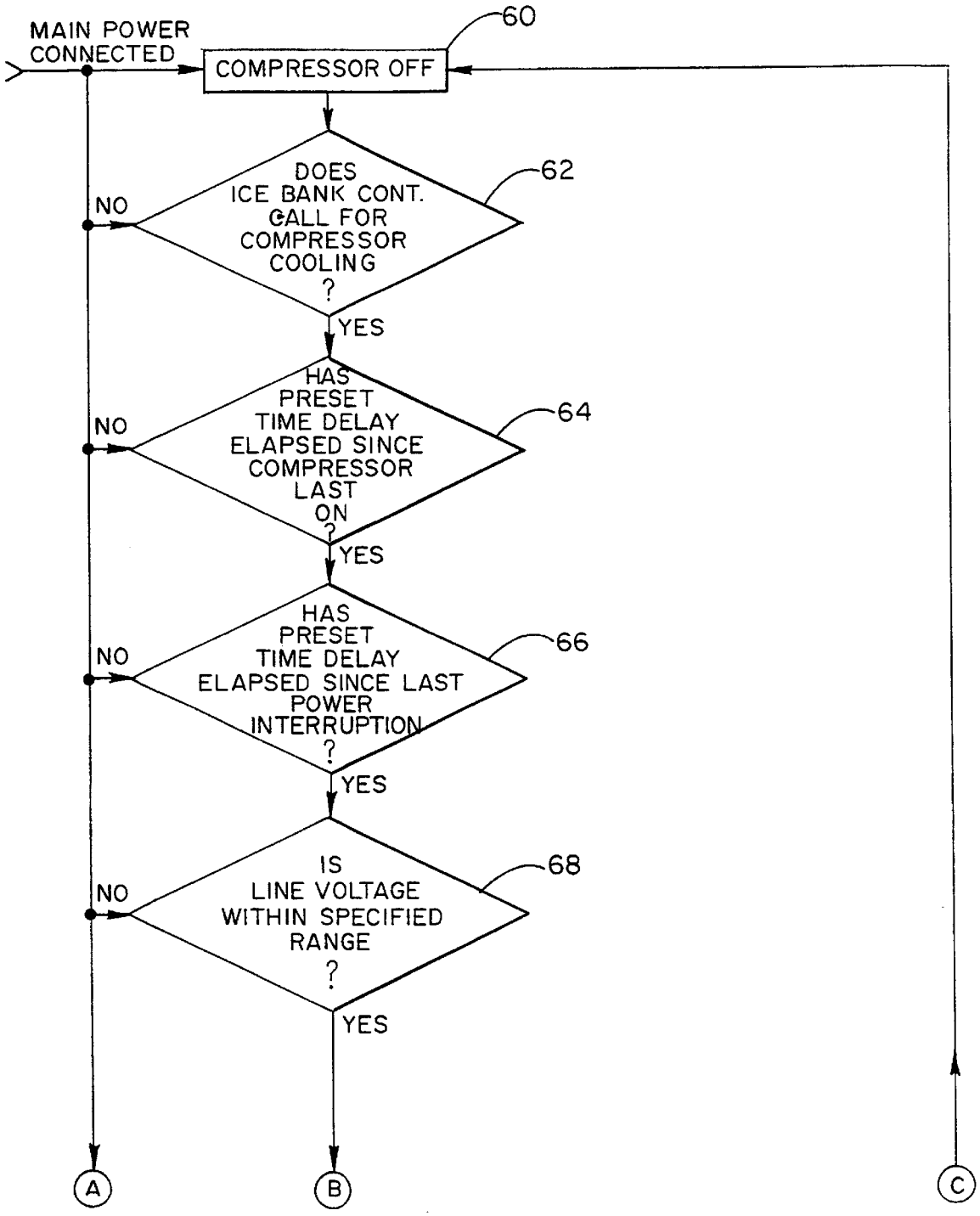
FIGS. 3A and 3B show a flow diagram of the operational control of the present invention.
Figure 3B:
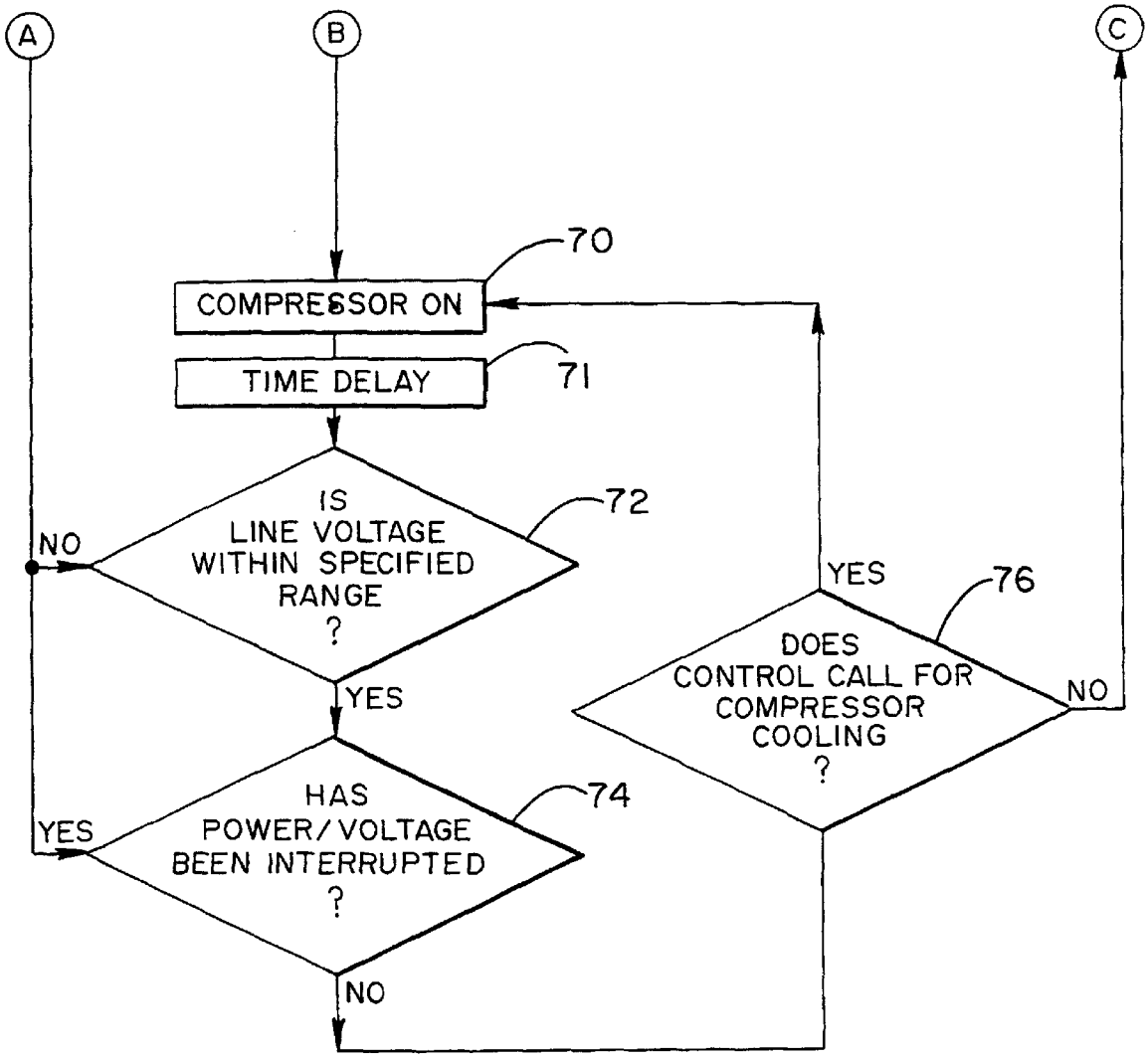

As seen in the block diagram of FIG. 2, control 10 is used in the context of a beverage dispensing machine 40. As is known in the art dispenser 40 includes a water bath tank 42 containing a volume of water and an evaporator 44. Evaporator 44 is part of a mechanical refrigeration system including compressor 30, a plurality of refrigerant lines 45, a condenser 46, a condenser cooling fan 48, and an expansion valve 49. As is well known in the art, the refrigeration system operates to cool evaporator 44 to form an ice bank 50 thereon. Probes P1 and P2 are seen within dashed circle 52 in enlarged form, relative to ice bank 50. Those of skill will appreciate that probes P1 and P2 are in actuality positioned at a distance from evaporator 44 to which it is desired that ice bank 52 is to grow. As is also known, a plurality of beverage lines 54 extend through bath 42 and deliver potable beverage from sources thereof, not shown, to one or more beverage dispensing valves 56. Thus, ice bank 50 provides a cooling reserve for the heat exchange cooling of the beverages as they pass through lines 54 so that compressor 30 need not run all the time that cooling is required. A light 58 indicates when compressor 30 is running.

The general operation of electrical conductivity based ice bank controls is well known in the art. The conductivity approach takes advantage of the substantial known difference between the electrical conductivity of water and that of ice. Thus, where the sensed electrical conductivity is low due to essentially no current flow between the probes, ice is indicated as ice is a poor electrical conductor. Conversely, when current is readily conducted between the probes, then water there between is indicated as the conductivity thereof, in most conditions, is dramatically higher than that of ice. Accordingly, when a high conductivity is sensed water between the probes is indicated. As a result thereof, it is assumed that the ice bank has eroded to a point that the refrigeration system must be turned on to build the ice bank up to a size that maintains an adequate cooling reserve. Once the probes are again covered with ice, the lower conductivity is sensed and it is assumed that the ice bank has grown back to its desired size and further refrigeration can be stopped.

In the present invention, a current is passed between probes P1 and P2 from line L5 by operation of circuits 18 and 20. The present invention uses the known convention, as represented specifically by circuit 20, of alternating the voltage there between to eliminate a net electrical plating or deposition on either probe P1 or P2. Thus, microprocessor 16 serves to control that voltage switching. As described above, when the conductivity between probes P1 and P2 is sensed as high by microprocessor 16, water there between is indicated and compressor 30 can be turned on. Conversely, when the sensed electrical conductivity is low, ice between probes P1 and P2 is indicated, and compressor 30 can be shut down.

To get a better understanding of the specific mode of operation of the present invention with respect to the control and interrelation of voltage sensing and conductivity sensing, attention is drawn to the flow diagrams 3A and 3B. At block 60 compressor 30 is off and at block 62 microprocessor 16 is continually reviewing the conductivity data as produced by probes P1 and P2 and circuit 18. If the conductivity reading indicates that water is present, then the yes arrow is followed from block 62 to block 64. If ice is indicated, then no further cooling is required and the system returns to compressor off block 60. At block 64 a preset time delay is contained in the controlling software, as is known in the art to prevent the startup of compressor 30 prior to the elapse of a predetermined time period. That time period, such as three minutes, serves to protect compressor 30 from destructive short cycling. If this protective predetermined time period has timed out, then the control logic proceeds to block 66. It can be appreciated that voltage detection circuit 14 can sense if there has been a power interruption where the sensed voltage drops to zero. Thus, the control of the present invention has a further short cycling safeguard represented by block 66 where, if power is interrupted, the above predetermined time delay is also utilized to prevent premature start up of compressor 30. If the predetermined time period has also timed out since the last power interruption, then at block 68, circuit 14 is used to determine if the sensed line voltage is within the recommended operating limits of compressor 30. If the sensed voltage is within such parameters, then at this point, block 70, compressor 30 can be turned on. After a time delay represented by block 71, microprocessor 16 continually monitors the line voltage, whether or not there has been a power outage and whether of not probes P1 and P2 are indicating that cooling is still required. The foregoing monitoring is represented by blocks 72, 74 and 76 respectively. Thus, if after the time delay of block 71, the line voltage goes out of range, or the power is interrupted or probes P1 and P2 become covered with ice and no further growth of the ice bank is required, then the system herein returns to the compressor off condition of block 60.

Those of skill will appreciate that the control of the present invention can provide for both line voltage compressor protection and ice bank sensing and management at a very minimal cost over the cost of ice bank management alone. Thus, it is cost effective that the control herein be used as a standard item rather than as a custom control only for the beverage dispensing machines thought to have the greatest likelihood of encountering voltages outside of the compressor's design limitations.

What is claimed is:

1. A control for operating a beverage dispensing machine, the beverage dispensing machine having a refrigeration system including a compressor for cooling an evaporator positioned in a water bath for forming an ice bank thereon, the control comprising:

a voltage sensing circuit for determining the voltage of an incoming line providing power to the compressor, an ice bank sensing system including conductivity probes positioned within the water bath and a conductivity sensing circuit for determining the conductivity between the probes and the compressor operated to provide for cooling of the evaporator for forming ice thereon when the voltage sensing circuit determines that the incoming line voltage is within design limits of the compressor, and when the ice bank sensing system determines that further formation of ice is required and when a predetermined time delay has timed out since the compressor last operated.

2. The control as defined in claim 1 and the voltage sensing circuit also sensing for a power outage and not running the compressor for the predetermined time period subsequent to the sensing of a power outage.

* * * * *